US008708726B2

(12) United States Patent
Campbell et al.

(10) Patent No.: US 8,708,726 B2
(45) Date of Patent: Apr. 29, 2014

(54) ELECTRICAL CONNECTOR SYSTEM WITH REPLACEABLE SEALING ELEMENT

(75) Inventors: Charles O. Campbell, Santa Rosa, CA (US); Roger C. Williams, Santa Rosa, CA (US)

(73) Assignee: ITT Manufacturing Enterprises LLC, Wilmington, DE (US)

( * ) Notice: Subject to any disclaimer, the term of this patent is extended or adjusted under 35 U.S.C. 154(b) by 142 days.

(21) Appl. No.: 13/564,183

(22) Filed: Aug. 1, 2012

(65) Prior Publication Data

US 2014/0038443 A1 Feb. 6, 2014

(51) Int. Cl.
*H01R 13/52* (2006.01)

(52) U.S. Cl.
USPC ..... 439/271; 439/272

(58) Field of Classification Search
USPC ..... 439/271, 272
IPC ..... H01R 13/5219,13/5205
See application file for complete search history.

(56) References Cited

U.S. PATENT DOCUMENTS

| | | | | |
|---|---|---|---|---|
| 3,609,636 | A | 9/1971 | Kubin et al. | |
| 4,706,744 | A | 11/1987 | Smith et al. | |
| 4,909,741 | A | 3/1990 | Schasteen et al. | |
| 5,439,386 | A | 8/1995 | Ellis et al. | |
| 5,704,799 | A * | 1/1998 | Wood | 439/281 |
| 5,957,715 | A * | 9/1999 | Fukuda | 439/271 |
| 5,984,709 | A | 11/1999 | Zink et al. | |
| 7,146,697 | B2 | 12/2006 | Chan et al. | |
| 7,165,610 | B2 | 1/2007 | Hopper | |
| 7,255,585 | B2 * | 8/2007 | Kameyama et al. | 439/271 |
| 7,350,577 | B2 | 4/2008 | Howard et al. | |
| 7,380,841 | B2 | 6/2008 | Hall et al. | |
| 7,500,516 | B2 | 3/2009 | Borak | |
| 7,566,235 | B2 | 7/2009 | Bottos et al. | |
| 7,726,996 | B2 * | 6/2010 | Burris et al. | 439/271 |
| 7,726,997 | B2 | 6/2010 | Kennedy et al. | |
| 7,762,824 | B2 | 7/2010 | Smith, III | |
| 7,832,503 | B2 | 11/2010 | Sand et al. | |
| 8,079,862 | B2 | 12/2011 | Marklove et al. | |
| 8,110,741 | B2 | 2/2012 | Brotzell et al. | |
| 2005/0208833 | A1 | 9/2005 | Oksengorn | |
| 2010/0041271 | A1 | 2/2010 | Van Swearingen et al. | |

FOREIGN PATENT DOCUMENTS

| | | |
|---|---|---|
| CN | 201774059 U | 3/2011 |
| CN | 202076549 U | 12/2011 |

OTHER PUBLICATIONS

International Search Report, mailed Oct. 4, 2013, of corresponding International Application No. PCTUS2013/050790.

* cited by examiner

*Primary Examiner* — Hien Vu
(74) *Attorney, Agent, or Firm* — RatnerPrestia

(57) ABSTRACT

A replaceable sealing element for sealing together two mating electrical connectors includes a sealing body having two opposed ends, a side wall extending between the two opposed ends, a threaded portion that is defined on the side wall for releasably mating with a first electrical connector of the mating electrical connectors, and either a slot or a protrusion at one of the opposed ends of the sealing body that is configured to be accessed by a tool for replacing the sealing element. A first seal is positioned on the side wall for sealing contact with the first electrical connector. A second seal is positioned on the side wall for sealing contact with a second electrical connector of the mating electrical connectors. Also described is an electrical connector having a replaceable sealing element.

18 Claims, 2 Drawing Sheets

ELECTRICAL CONNECTOR SYSTEM WITH REPLACEABLE SEALING ELEMENT

FIELD OF THE INVENTION

The present invention relates to an electrical connector having a replaceable sealing element.

BACKGROUND OF THE INVENTION

Electrical connector systems that are immersed in liquid, such as a well environment, are ordinarily protected from the surrounding harsh environment by a fluid-tight seal. The fluid-tight seal is ordinarily a permanent part of the connector system that wears out over time, thereby diminishing the seal's ability to continually seal over varying temperature and pressure. This invention is directed to an electrical connector system having a replaceable sealing element.

SUMMARY OF THE INVENTION

According to one aspect of the invention, a replaceable sealing element for sealing together two mating electrical connectors comprises a sealing body and two seals. The sealing body includes two opposed ends and a side wall extending between the two opposed ends, a threaded portion that is defined on the side wall for releasably mating with a first electrical connector of the mating electrical connectors, either a slot or a protrusion at one of the opposed ends of the sealing body that is configured to be accessed by a tool for replacing the sealing element. A first seal is positioned on the side wall for sealing contact with the first electrical connector. A second seal is positioned on the side wall for sealing contact with a second electrical connector of the mating electrical connectors.

According to another aspect of the invention, an electrical connector that is configured to be connected to a mating electrical connector comprises either a pin or a socket that is positioned within a connector body and a coupling sleeve that is positioned over the connector body; and a replaceable sealing element that at least partially surrounds the connector body and is configured to be releasably connected to the coupling sleeve. The replaceable sealing element includes (a) a sealing body including two opposed ends and a side wall extending between the two opposed ends, and either a slot or a protrusion at one of the opposed ends of the sealing body that is configured to be accessed by a tool for releasably connecting the sealing element to the coupling sleeve, (b) a first seal that is positioned on the side wall of the sealing body for sealing contact with the coupling sleeve, and (c) a second seal that is positioned on the side wall of the sealing body for sealing contact with the mating electrical connector.

According to yet another aspect of the invention, a replaceable sealing element for sealing together two mating electrical connectors comprises a sealing body and two seals. The sealing body includes two opposed ends and a side wall extending between the two opposed ends, either a slot or a protrusion at one of the opposed ends of the sealing body that is configured to be accessed by a tool for replacing the sealing element, and a shoulder formed between the opposed ends upon which a surface of one of the electrical connectors bears. A first seal is positioned on the side wall for sealing contact with a first electrical connector of the mating electrical connectors. A second seal is positioned on the side wall for sealing contact with a second electrical connector of the mating electrical connectors.

BRIEF DESCRIPTION OF THE DRAWINGS

The invention is best understood from the following detailed description when read in connection with the accompanying drawing. It is emphasized that, according to common practice, the various features of the drawing are shown schematically and may not be to scale. Included in the drawing are the following figures.

DETAILED DESCRIPTION OF THE INVENTION

Figure 1:
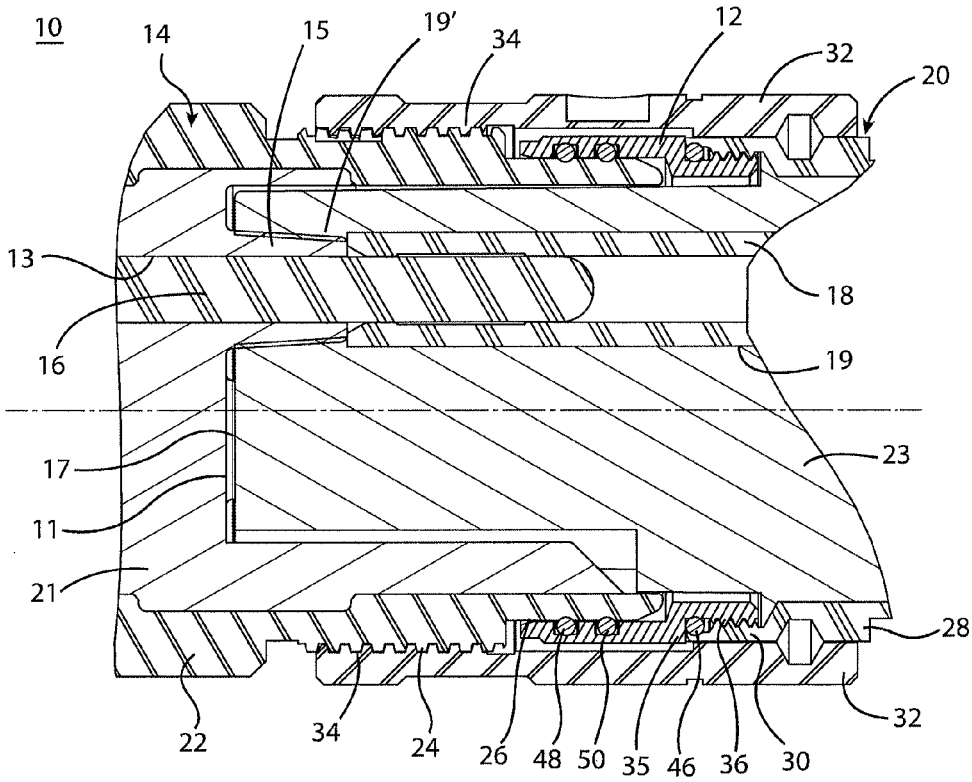
FIG. 1 depicts a cross-sectional view of an electrical connector assembly including a replaceable sealing element, according to one exemplary embodiment of the invention.

The invention will next be illustrated with reference to the figures. Such figures are intended to be illustrative rather than limiting and are included herewith to facilitate explanation of the present invention. In the figures, like item numbers refer to like elements throughout. While many of the features shown in the drawings are shown in cross-section, it should be understood that those components have a substantially cylindrical shape.

FIG. 1 depicts a cross-sectional view of an electrical connector assembly 10, according to one exemplary embodiment of the invention. The connector assembly 10 generally includes a male connector 14 and a female connector 20. The female connector 20, which includes a replaceable sealing element 12, is depicted by itself in FIG. 2. The longitudinal axis of the connector assembly 10 is depicted by a horizontal broken line in FIG. 1.

The male connector 14 includes a molded connector body 21 and one or more pins 16 (only one shown) that are positioned within the molded connector body 21. The molded connector body 21 includes a bearing surface 11, and one or more openings 13 for accommodating the one or more pins 16, respectively. At each opening 13, a frusto-conically shaped protrusion 15 extends outwardly from the bearing surface 11.

The female connector 20 includes a molded connector body 23 and one or more sockets 18 (only one shown) that are positioned within the molded connector body 23. The molded connector body 23 includes a bearing surface 17 and one or more countersunk openings 19 for connection with one or more sockets 18 of the male connector 14.

In an assembled form of the connector 10, each pin 16 of the male connector 14 is releasably mated with a socket 18 of the female connector 20 to establish an electrical connection therebetween. The bearing surfaces 11 and 17 of the connector sub-assemblies are positioned either in contact or in close proximity to one another, as shown in FIG. 1. The frusto-conically shaped protrusions 15 of the male connector 14 are positioned in respective countersinks 19' of the female connector 20.

The male connector 14 is configured to be releasably and sealingly connected to the female connector 20, as will be explained hereinafter. The male connector 14 includes a cylindrical coupling sleeve 22 that both surrounds and is fixedly mounted to the molded connector body 21. The exterior surface of the coupling sleeve 22 includes a threaded portion 24 and a sealing face 26 at its free end. The threaded portion 24 of the coupling sleeve 22 is configured for releasably mating with a coupling nut 32 of the female connector 20.

The female connector 20 includes a cylindrical coupling sleeve 28 that both surrounds and is fixedly mounted to the molded connector body 23. The interior surface of the coupling sleeve 28 includes a threaded portion 30 at a terminal end thereof that is configured to be releasably mounted to the replaceable sealing element 12.

The female connector 20 includes a ring-shaped coupling nut 32 that is rotatably mounted to the free end of the coupling sleeve 28. The coupling nut 32 at least partially surrounds the coupling sleeve 28 and the replaceable sealing element 12. The coupling nut 32 is freely rotatably with respect to the coupling sleeve 28, however, the coupling nut 32 is not capable of translating along the length of the coupling sleeve 28 at least according to one exemplary embodiment of the invention. The interior surface of the coupling nut 32 includes a threaded portion 34 that is configured for releasably mating with the threaded portion 24 of the coupling sleeve 22 of the male connector 14, as shown in FIG. 1. In an assembled form of the connector 10, the threaded portions 24 and 34 are releasably connected together.

Figure 2:
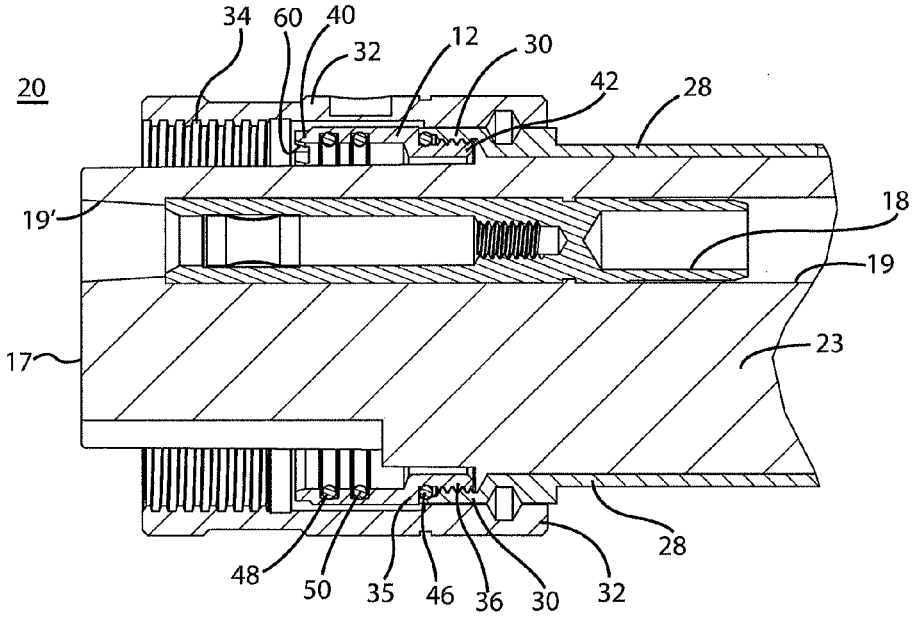
FIG. 2 depicts a cross-sectional view of the female connector of the electrical connector assembly of FIG. 1.
Figure 3:
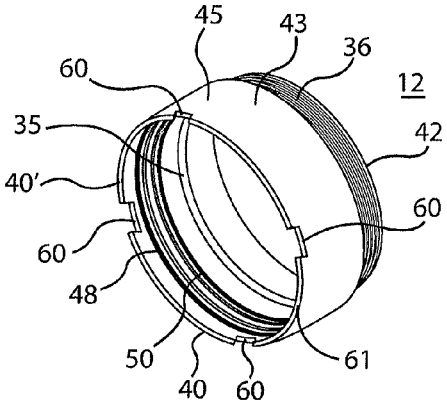
FIG. 3 depicts a perspective view of the replaceable sealing element of FIGS. 1 and 2.

The female connector 20 includes a replaceable sealing element 12 that is configured for sealing the connectors 14 and 20 together in a fluid-tight manner. FIG. 3 depicts a perspective view of the replaceable sealing element 12 of FIGS. 1 and 2. The replaceable sealing element 12 includes a semi-cylindrical sealing body 45 and three O-rings 46, 48 and 50 that are attached to the semi-cylindrical sealing body 45.

The semi-cylindrical sealing body 45 includes a free end 40 of a first diameter, a fixed end 42 of a second diameter, which is less than the first diameter, and a side wall 43 extending between the ends 40 and 42. An annular shoulder 35 is formed on the side wall 43 between the ends 40 and 42.

The exterior facing surface of the fixed end 42 of the replaceable sealing element 12 includes a threaded portion 36 that is configured to be releasably mounted to the threaded portion 30 of the coupling sleeve 28 of the female connector 20. In an assembled form of the female connector 20, the threaded portion 36 of the replaceable sealing element 12 is threaded onto the threaded portion 30 of the coupling sleeve 28 until the shoulder 35 of the sealing body 45 abuts the terminal end of the coupling sleeve 28, as shown in FIGS. 1 and 2.

An O-ring 46 is positioned on the fixed end 42 of the replaceable sealing element 12 at a location between the threaded portion 36 and the shoulder 35. In the assembled form of the female connector 20, the O-ring 46 is compressed between the outer surface of the fixed end 42 of the sealing element 12 and the inner surface of the terminal end of the coupling sleeve 28. The O-ring 46 prevents the ingress of fluid at the interface between the coupling sleeve 28 and the sealing body 45.

The interior surface of the free end 40 of the sealing body 45 includes two annular grooves that are sized to receive O-rings 48 and 50. The O-ring 48, which forms a primary seal, is positioned closest to the threaded portion 24 of the coupling sleeve 22. The O-ring 50, which forms a secondary seal, is positioned further from the threaded portion 24. In the assembled form of the connector 10, the O-rings 48 and 50 are compressed between the grooves of the sealing element 12 and the sealing face 26 of the coupling sleeve 22. The O-rings 48 and 50 prevents the ingress of fluid at the interface between the coupling sleeve 22 and the sealing body 45. In use, any fluid that passes between the threaded portions 24 and 34 is substantially prevented by both O-rings 48 and 50 from approaching the molded connector body 23 of the female connector 20.

The free end 40 of the sealing body 45 includes a series of castellations 60 that extend along the axial length of the sealing element 12. The castellations 60 are evenly spaced around the circumference of the planar surface 40' of the free end 40. Each castellation 60 is a rectangular-shaped slot. Those skilled in the art will recognize that the number, shape and position of the castellations 60 may vary without departing from either the scope or the spirit of the invention. The castellations 60 could be replaced with prongs, protrusions, pins, inserts or fasteners, for example. Thus, item 60 may be broadly referred to as a tool engaging surface.

The replaceable sealing element 12 may be considered as forming a part of either the female connector 20 or the connector assembly 10. The replaceable sealing element 12 may be sold separately as a replacement part. The O-rings 46, 48 and 50 are attached to the sealing body 45 such that they do not become detached from the sealing body 45 upon removing the replaceable sealing element 12 from the female connector 20. The O-rings 46, 48 and 50 wear, degrade and harden over time. Periodically replacing the replaceable sealing element 12 and its O-rings 46, 48 and 50 is intended to is intended to restore the original sealing characteristics of the connector assembly 10.

Figure 4:
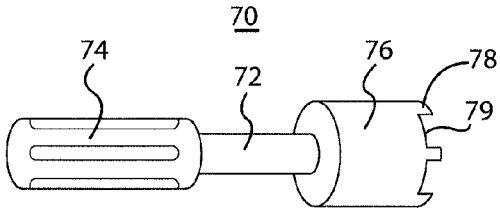
FIG. 4 depicts a tool for removing and/or installing the replaceable sealing element of FIGS. 1 and 2.

FIG. 4 depicts a tool 70 for removing and installing the replaceable sealing element 12 in the female connector 20. The tool 70 includes a shaft 72, handle 74 that is mounted at one end of the shaft 72, and a hollow socket 76 that is positioned at the opposing end of the shaft 72. The free end of the hollow socket 76 includes a set of prongs 78 that are configured to engage the castellations 60 of the replaceable sealing element 12. Alternatively, it may be considered that the prongs 61 of the replaceable sealing element 12 engage castellations 79 of the hollow socket 76.

It should be understood that the prongs 78 and the castellations 60 may vary from that which is shown and described so long as those features operate together to install and remove the replaceable sealing element 12.

According to one exemplary method of replacing the replaceable sealing element 12, the male connector 14 is first detached from the female connector 20 by rotating the coupling nut 32 in a counter-clockwise direction. The male connector 14 is then translated away from the female connector 20 to disengage the one or more pins 16 from their respective sockets 18.

After the male connector 14 is completely removed from the female connector 20, the hollow socket 76 of the tool 70 is positioned in the annular space between the female connector body 23 and the sealing element 12. The prongs 78 of the hollow socket 76 are oriented so that they are positioned within the castellations 60 of the replaceable sealing element 12. The tool 70 is then rotated, thereby disengaging the threaded portion 36 of the sealing element 12 from the threaded portion 30 of the coupling sleeve 28 of the female connector 20.

The used replaceable sealing element 12 is removed from the female connector 20 and discarded (if so desired). A new replaceable sealing element 12 is loaded on the tool 70 by positioning the prongs 78 of the hollow socket 76 so that they are positioned within the castellations 60 of the new sealing element 12. The tool 70 and the new sealing element 12 are positioned in the annular space between the coupling nut 32 and the female connector body 23. The tool 70 is rotated to engage the threaded portion 36 of the sealing element 12 with the threaded portion 30 of the coupling sleeve 28 until the shoulder 35 of the sealing element 12 bears upon the terminal end of the coupling sleeve 28, as shown in FIG. 1.

The one or more pins 16 of the male connector 14 are then slidably inserted into respective sockets 18 of the female connector 20. The male connector 14 is then rigidly attached to the female connector 20 by rotating the coupling nut 32 in a clockwise direction so that the threaded portion 34 of the coupling nut 32 engages the threaded portion 24 of the male connector 14.

The O-rings described herein are formed from an elastomeric material. The remaining components described herein may be formed of a metallic or a polymeric material by any known process.

While exemplary embodiments of the invention have been shown and described herein, it will be understood that such embodiments are provided by way of example only. Numerous variations, changes and substitutions will occur to those skilled in the art without departing from the spirit of the invention. For example, the connector 14 may include the sockets and the connector 20 may include the pins. Accordingly, it is intended that the appended claims cover all such variations as fall within the spirit and scope of the invention.

What is claimed:

1. A replaceable sealing element for sealing together two mating electrical connectors comprising:

a sealing body including two opposed ends and a side wall extending between the two opposed ends, a threaded portion that is defined on the side wall for releasably mating with a threaded mating portion of a first electrical connector of the mating electrical connectors, either a slot or a protrusion at one of the opposed ends of the sealing body that is configured to be accessed by a tool having a prong or a recess for replacing the sealing element, a first seal that is positioned on an outer surface of the side wall for sealing contact with the first electrical connector, and a second seal that is positioned on an inner surface of the side wall for sealing contact with a second electrical connector of the mating electrical connectors.

2. The replaceable sealing element of claim 1, wherein each seal of the replaceable sealing element is an O-ring.

3. The replaceable sealing element of claim 1, wherein the side wall of the sealing body includes a shoulder formed between the opposed ends upon which a surface of the first connector bears.

4. The replaceable sealing element of claim 1, wherein the seals are positioned on different surfaces of the side wall of the sealing body.

5. The replaceable sealing element of claim 1, wherein one of the two mating electrical connectors includes a pin and the other of the two mating connectors includes a mating socket for mating with the pin thereby establishing electrical continuity between the two mating electrical connectors.

6. The replaceable sealing element of claim 1, wherein said one of the opposed ends of the sealing body includes a plurality of slots or protrusions.

7. The replaceable sealing element of claim 6, wherein the plurality of slots or protrusions are spaced apart along a circumference of said one of the opposing ends of the sealing body.

8. The replaceable sealing element of claim 1, wherein the other of the opposed ends of the sealing body includes the threaded portion.

9. The replaceable sealing element of claim 1, further comprising a third seal that is positioned on the side wall for sealing contact with the second electrical connector of the mating electrical connectors.

10. The replaceable sealing element of claim 1, further comprising a groove formed in the side wall in which the second seal is positioned.

11. A kit including the replaceable sealing element of claim 1 and a tool having protrusions or slots for mating with the slots or protrusions of the sealing body.

12. A replaceable sealing element for sealing together two mating electrical connectors comprising:

a sealing body including two opposed ends and a side wall extending between the two opposed ends, either a slot or a protrusion at one of the opposed ends of the sealing body that is configured to be accessed by a tool having a prong or a recess for replacing the sealing element, and a shoulder formed between the opposed ends upon which a surface of one of the electrical connectors bears, a first seal that is positioned on an outer surface of the side wall for sealing contact with a first electrical connector of the mating electrical connectors, and a second seal that is positioned on an inner surface of the side wall for sealing contact with a second electrical connector of the mating electrical connectors, wherein a threaded portion that is defined on the side wall for releasably mating with a threaded mating portion of the first electrical connector of the mating electrical connectors.

13. The replaceable sealing element of claim 12, wherein said first seal is positioned between said shoulder and said threaded portion.

14. The replaceable sealing element of claim 12, wherein each seal of the replaceable sealing element is an O-ring.

15. The replaceable sealing element of claim 12, wherein the seals are positioned on different surfaces of the side wall of the sealing body.

16. The replaceable sealing element of claim 12, wherein said one of the opposed ends of the sealing element includes a plurality of slots or protrusions.

17. The replaceable sealing element of claim 16, wherein the plurality of slots or protrusions are spaced apart along a circumference of said one of the opposing ends of the sealing element.

18. An electrical connector that is configured to be connected to a mating electrical connector comprising:

either a pin or a socket that is positioned within a connector body and a coupling sleeve that is positioned over the connector body; and a replaceable sealing element that at least partially surrounds the connector body and is configured to be releasably connected to the coupling sleeve, said replaceable sealing element including (a) a sealing body including two opposed ends and a side wall extending between the two opposed ends, and either a slot or a protrusion at one of the opposed ends of the sealing body that is configured to be accessed by a tool having a prong or a recess for releasably connecting the sealing element to the coupling sleeve, (b) a first seal that is positioned on an outer surface of the side wall of the sealing body for sealing contact with the coupling sleeve, and (c) a second seal that is positioned on an inner surface of the side wall of the sealing body for sealing contact with the mating electrical connector.

* * * * *